US010495291B2

(12) United States Patent
Stegeman et al.

(10) Patent No.: US 10,495,291 B2
(45) **Date of Patent: *Dec. 3, 2019**

(54) COBRA ARM ENCLOSURE DEVICE

(71) Applicant: Labyrinth Technologies, LLC, Hazelwood, MO (US)

(72) Inventors: John T. Stegeman, Hazelwood, MO (US); Theodore J. Stegeman, Hazelwood, MO (US)

(73) Assignee: Labyrinth Technologies, LLC, Hazelwood, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/409,213

(22) Filed: May 10, 2019

(65) Prior Publication Data

US 2019/0264898 A1 Aug. 29, 2019

Related U.S. Application Data

(63) Continuation of application No. 16/384,898, filed on Apr. 15, 2019, which is a continuation of application (Continued)

(51) Int. Cl.
*F21V 19/00* (2006.01)
*F21V 21/00* (2006.01)

(Continued)

(52) U.S. Cl.
CPC ..... *F21V 21/116* (2013.01); *F21S 8/086* (2013.01); *F21V 23/008* (2013.01); *F21V 31/00* (2013.01);

(Continued)

(58) Field of Classification Search
CPC ..... F21V 21/06; F21V 23/023; F21V 29/70; F21V 23/003; F21V 23/02; F21V 5/04; F21V 29/89; F21V 21/30; F21V 23/006; F21V 23/009; F21V 19/0085; F21V 21/005; F21V 21/116; F21V 23/004; F21V 23/06; F21V 3/0625; F21V 7/10; F21V 15/01; F21V 29/83; F21V 31/005; F21V 23/04; F21V 33/006; F21V 3/00; F21V 3/02;

(Continued)

(56) References Cited

U.S. PATENT DOCUMENTS

2003/0152423 A1 8/2003 Wu
2005/0168169 A1 8/2005 Kurachi et al.

(Continued)

*Primary Examiner* — Thien T Mai
(74) *Attorney, Agent, or Firm* — Lewis Rice LLC

(57) ABSTRACT

A cobra arm enclosure device has a hull, a lid, and features for a light pole and a light fixture to attach hereto. The device has a generally rectangular prismatic form that sheds precipitation and ice. It has a top surface upon the lid, a bottom surface upon the hull, a left side, a right side, a front, and a back. The enclosure has an extension that fits into a light fixture. The back of the enclosure has a receiver that fits upon a light pole arm. The enclosure has a width generally greater than that of the cobra arm. Within the invention, it has a storage capacity for electrical components. The invention is an inline enclosure for direct transmission of electrical power and signaling. The invention serves in a system where a central control operates street lighting across a city.

29 Claims, 8 Drawing Sheets

Related U.S. Application Data

No. 15/656,675, filed on Jul. 21, 2017, now Pat. No. 10,260,719.

(60) Provisional application No. 62/368,574, filed on Jul. 29, 2016.

(51) Int. Cl.

| | |
|---|---|
| ***F21V 21/116*** | (2006.01) |
| ***F21S 8/08*** | (2006.01) |
| ***F21V 23/00*** | (2015.01) |
| ***F21V 31/00*** | (2006.01) |
| *F21Y 115/10* | (2016.01) |
| *F21W 131/103* | (2006.01) |

(52) U.S. Cl.
CPC .... *F21W 2131/103* (2013.01); *F21Y 2115/10* (2016.08)

(58) Field of Classification Search
CPC ..... F21V 9/30; F21V 19/005; F21V 21/02; F21V 21/34; F21V 23/002; F21V 29/75; F21V 29/763; F21V 9/08; F21V 13/04; F21V 17/12; F21V 21/03; F21V 21/04; F21V 21/14; F21V 29/507; F21V 29/71; F21V 7/005; F21V 14/02; F21V 15/005; F21V 17/02; F21V 21/0824; F21V 21/088; F21V 23/0442; F21V 29/004; F21V 29/74; F21V 14/06; F21V 17/007; F21V 21/096; F21V 21/22; F21V 21/26; F21V 21/40; F21V 23/007; F21V 29/77; F21V 33/00; F21V 13/02; F21V 13/12; F21V 14/00; F21V 15/00; F21V 15/013; F21V 15/02; F21V 19/001; F21V 19/0055; F21V 19/02; F21V 21/00; F21V 21/008; F21V 21/048; F21V 21/08; F21V 21/108; F21V 21/28; F21V 21/32; F21V 21/35; F21V 23/001; F21V 23/008; F21V 23/0435; F21V 23/045; F21V 23/0464; F21V 23/0471; F21V 23/0478; F21V 27/00; F21V 27/02; F21V 29/006; F21V 29/506; F21V 29/508; F21V 29/56; F21V 29/673; F21V 29/713; F21V 29/717; F21V 29/73; F21V 29/745; F21V 29/773; F21V 29/80; F21V 29/90; F21V 31/00; F21V 31/03; F21V 31/04; F21V 33/0052; F21V 3/026; F21V 5/008; F21V 7/0083; F21V 7/28; F21Y 2115/10; F21Y 2103/10; F21Y 2101/00; F21Y 2113/00; F21Y 2105/16; F21Y 2105/10; F21Y 2103/00; F21Y 2107/30; F21Y 2107/40; F21Y 2113/13; F21Y 2113/20; F21Y 2115/15; F21Y 2115/30

See application file for complete search history.

(56) References Cited

U.S. PATENT DOCUMENTS

| | | | | |
|---|---|---|---|---|
| 2006/0044789 | A1* | 3/2006 | Curtis | F21S 8/088 362/152 |
| 2011/0171080 | A1 | 7/2011 | Lo | |
| 2012/0020060 | A1 | 1/2012 | Myer et al. | |
| 2012/0143383 | A1* | 6/2012 | Cooperrider | H04Q 9/00 700/295 |
| 2012/0327639 | A1 | 12/2012 | Chen | |
| 2013/0077327 | A1* | 3/2013 | Butler | F21V 21/06 362/431 |
| 2013/0107520 | A1 | 5/2013 | O'Kane | |
| 2013/0142372 | A1* | 6/2013 | Harwood | H04R 1/028 381/334 |
| 2016/0318568 | A1 | 11/2016 | Hosoda et al. | |
| 2018/0031213 | A1 | 2/2018 | Stegeman et al. | |

* cited by examiner

COBRA ARM ENCLOSURE DEVICE

CROSS-REFERENCE TO RELATED APPLICATIONS

This application is a continuation of U.S. patent application Ser. No. 16/384,898, filed Apr. 15, 2019. U.S. patent application Ser. No. 16/384,898 is a continuation of U.S. patent application Ser. No. 15/656,675, filed Jul. 21, 2017, and now granted as U.S. Pat. No. 10,260,719. U.S. patent application Ser. No. 15/656,675 claims the benefit of U.S. Prov. App. Ser. No. 62/368,574, filed Jul. 29, 2016. The entire disclosure of all of these references is incorporated herein by reference.

BACKGROUND OF THE INVENTION

Field of the Invention

The cobra arm enclosure device generally relates to street lighting equipment and more specifically to an inline enclosure for direct transmission of electrical power and signal through it to a street light. The enclosure also connects with a light emitting diode street light.

Description of the Related Art

Darkness has dogged people for millennia. Some people use darkness for good while others use it for ill. Darkness limits the ability of diurnal people to do things. In ancient times, people dispelled darkness with various torches and cauldrons. In more recent centuries, people developed candles, firebrands, and pots of pitch. These plant and animal based light sources worked to a point. These light sources had a limited lifespan and select persons would have to replenish them.

Such light sources were often carried by a person to illuminate his path, usually of walking. For some persons, such light sources illuminated the path of horses and oxen. Alas persons of lesser means would walk along streets and paths in darkness. Untold horrors would befall those who walked in darkness.

Municipal leaders in the last two centuries determined that lighting of streets protects those who walk upon them without their own light source. A recent jurist quipped that "light is the best policeman." Municipal leaders realized street lighting also reduced crime. In the last century, various cities and then towns and villages developed lighting systems for their streets. Such systems began with gas lamps lit by a lamplighter and evolved into arc lighting.

In recent decades, city lighting systems have become electrified across entire cities using alternating current. Thomas Edison developed the light bulb and a power generation and distribution system. George Westinghouse further developed and deployed a power generation and distribution system widely across a city for lighting among other things. Cities have emplaced various lighting systems from various manufacturers over the years. Like other devices, lighting systems faces the elements and hazards of time. Eventually, a lighting system calls for maintenance. Many lighting systems, being under municipal ownerships, compete with other programs for funding. Various reports have noted that many years, often a decade, may elapse before a city employee inspects a street light. In some cities, street lights by the thousands or by at least 20% do not work. Once more, darkness like in olden times retakes parts of cities.

A city lighting systems has a fleet of poles deployed across a city following various building codes and lighting codes adopted by a city. A street will have so many light poles per linear mile. A typical street light begins with a pedestal installed near a road. Electric utility service provides a power line to the pedestal. The light continues with a pole placed upon the pedestal. The pole may be concrete, galvanized steel, or other alloy suitable to long exposure to the elements and vehicles. The pole has a slender elongated form that tapers upwardly. The pole has two ends with one securing to the pedestal and the other end elevated above the street, typically at least twenty feet for truck clearance. The elevated end has an arm that extends outwardly and over a street and possibly adjacent sidewalk. The arm has a light fixture upon its on end above the street. The light fixture receives power from the utility service line and turns on and off utilizing a solar cell at the light pole or at the substation. A typical street light operates with some autonomy.

In recent years, street light arms have acquired a pleasing curved shape. Such arms have the name of cobra arm for a similarity of appearance to a snake of the same name. At the end of the cobra arms, lights have had various forms with the sodium vapor light having popularity at present. Such lights provide a damp orange glow pleasing to the eye at night without blinding pedestrians and motorists near such lights. Such lights have their operating costs and their maintenance increases as they near their design life around 18,000 operating hours.

Lately, light emitting diode, or LED lighting, has appeared. Select LED fixtures have the power consumption, illumination levels, and operating costs more desirable than existing sodium vapor lights. The LED lights may attach to cobra arms and receive power from existing utility service lines in the poles. That leaves LED lights similarly autonomous as their predecessors.

The present invention overcomes the difficulties of the prior art. That is, the prior art has autonomous light poles without central controls and protection of electrical components from the elements at each light pole. The present invention collects electrical components within a housing at each light pole, installs upon an existing light pole and utility service, receives an LED fixture, and allows for central control of an entire lighting system.

SUMMARY OF THE INVENTION

Generally, the present invention is a cobra arm enclosure device that has an enclosure of a lid upon a hull, storage capacity for electrical and electronic components within the enclosure, and fittings for a light pole and a light fixture to attach thereto. The hull and the lid form an enclosure of a generally rectangular prismatic form that sheds ice and precipitation. It has a top surface, a bottom surface, a left side, a right side, a front, and back. The front of the hull has an extension that fits into a receptacle of a light fixture or LED. The back of the hull has a receiver that fits the invention upon a cobra type arm upon a light pole.

The enclosure has a width generally greater than that of the cobra arm. The invention provides an inline enclosure for direct transmission of electrical power and signal through it. The enclosure provides storage space for a power supply and other electrical components such as a processor, memory, antenna, and the like.

The enclosure may receive an antenna that communicates using 900 MHz or Wi-Fi internet, to a centralized 4G signal control hub. The central control then communicates with a cloud based server application with a user interface to operate, maintain, and direct an entire fleet of light poles across a city. More particularly, the invention encloses a paired device node, or PDN, unit that itself communicates through a 900 MHz RF mesh network to the other units to then send communication signals through the network. The PDN within the invention receives its commands from a hub device node, or HDN. The HDN also communicates to the PDN through the 900 MHz network. The PDN utilizes a 4G signal in communication with a cloud based server program. This program allows a user to control and modify the state of the network and to receive information about the network.

The cobra arm enclosure device provides additional volume to receive and to mount electrical devices therein. The cobra arm enclosure device fits upon the upper fitting of an existing standard light pole. The cobra arm enclosure device has an extension of the same size as a standard light pole to accept any light fixture. The cobra arm enclosure device provides an inline, or collinear, tap into the electrical power supply from the standard light pole into a light fixture. The cobra arm enclosure device has weather tight construction. The cobra arm enclosure device houses, and positions, electrical devices therein to reduce the accumulation of heat in and near the electrical devices.

There has thus been outlined, rather broadly, the more important features of the invention in order that the detailed description thereof that follows may be better understood and that the present contribution to the art may be better appreciated. The present invention also includes a second processor, a notch in the socket to receive an LED strip from a cobra arm, and a method of operating a light fixture capable of scaling across a municipal lighting system. Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a cobra arm enclosure device that attaches readily upon an existing light pole.

Another object is to provide a cobra arm enclosure device that allows for introducing additional electrical components to the base of a light fixture. Another object is to provide a cobra arm enclosure device that calls for no modifications to an existing light fixture.

Another object is to provide a cobra arm enclosure device that calls for using existing certifications and avoids recertification.

Another object is to provide a cobra arm enclosure device that calls for no modifications to an existing light pole thus reducing installation costs.

Another object is to provide a cobra arm enclosure device that mounts between an existing light pole and a light fixture and receives additional electrical components and avoids purchase of a new light fixture.

Another object is to provide a cobra arm enclosure device that separates electrical components therein from heat sources.

Another object is to provide a cobra arm enclosure device that has electrical components therein operating at lower temperatures.

Another object is to provide a cobra arm enclosure device that calls for no new wiring or cables from an existing pole for its installation.

Another object is to provide a cobra arm enclosure device that monitors electrical power draw from a light fixture utilizing an inline installation. Another object is to provide a cobra arm enclosure device that reduces installation time and cost.

Another object is to provide a cobra arm enclosure device that minimizes cost of tapping power for separate devices.

Another object is to provide a cobra arm enclosure device that provides a common power source for its internal components.

Another object is to provide a cobra arm enclosure device that has a low manufacturing cost that permits sales of the device to governments, agencies, individuals and business entities through various supply sources including catalogs, websites, discount stores, home decorating centers, warehouse clubs, and other high traffic stores.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT(S)

Figure 1:
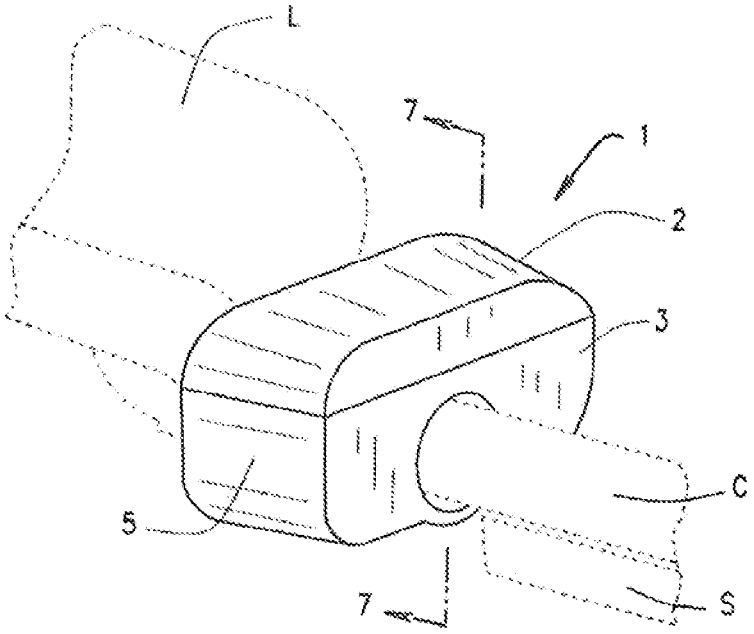
FIG. 1 illustrates a perspective view of the invention deployed upon a light pole.

The present invention overcomes the prior art limitations and provides a cobra arm enclosure device that installs readily upon any existing pole, light pole, tower, and the like, typically along a road within a municipality. FIG. 1 shows a perspective view of a portion of any light L outwardly and coaxial with a cobra arm C and the invention installing upon an end of the cobra arm C and receiving the light L of any make or model. A strip of light emitting diode lighting, as at S, optionally may connect to the cobra arm C along at least a portion of its length.

The invention has an enclosure 1 of a generally prismatic shape with a lid 2 here shown spaced above the cobra arm and transverse, a back surface 3*a* of a hull 3 generally perpendicular to the lid 2, transverse the cobra arm and intersecting the cobra arm, and a right side 5 of the hull spanning from a joint with the lid to the back surface as shown. The lid and the back surface 3*a* define the width of the enclosure generally larger than the diameter of the cobra arm and the width of the light L. The back surface of the hull generally receives the cobra arm as the invention installs upon the end of the cobra arm. The enclosure 1 has at least one aperture therein for external access of electronics stored within the invention, such as antennae and the like. The lid has a rounded over joining to the right side 5 of the hull 3 and the right side has a similar rounded over joining to the back surface of the hull 3 so that the invention sheds moisture, rain, snow, and prevents ice formation.

The enclosure may hold various contents suitable for regulating and controlling a light. Such contents may include a power supply, a processor in electrical communication with the power supply, a memory in electrical communication with the processor, a radio unit in electrical communication with the power supply and the processor and data communication with an antenna, and a second processor in electrical communication with the power supply, among other things. The applicants foresee additional and alternate electrical components placed within the enclosure 1. The present invention provides for an inline connection upon a light pole without having to run additional electrical wiring and electrical connections, for a location to isolate electronics placed within it, and for receiving a node that communicates to a central control, or brain, that makes a plurality of lights smart and subject to coordinated signals from a single source. Though shown in rectangular prismatic form, the power supply, processor, memory, radio unit, second processor, and the like may have other shapes suitable for fitting within the enclosure, around the end of the cobra arm, and around other components. The power supply connects to the electrical lines of an existing light pole and conditions the power for use by the electrical components within the invention. The antenna provides Wi-Fi radio communications from the invention to a controlling computer, not shown. The controlling computer regulates the operating of the light L through the various components contained within the enclosure. The processor and second processor send commands and control to the light fixture L for its operation as directed from the controlling computer.

As in FIG. 1, the cobra arm C has a strip of LED lighting as at S along its length. The strip S attaches to the cobra arm utilizing a plurality of clamps spaced upon an interval along the length of the cobra arm. Alternatively the strip attaches with an adhesive to the cobra arm.

Figure 2:
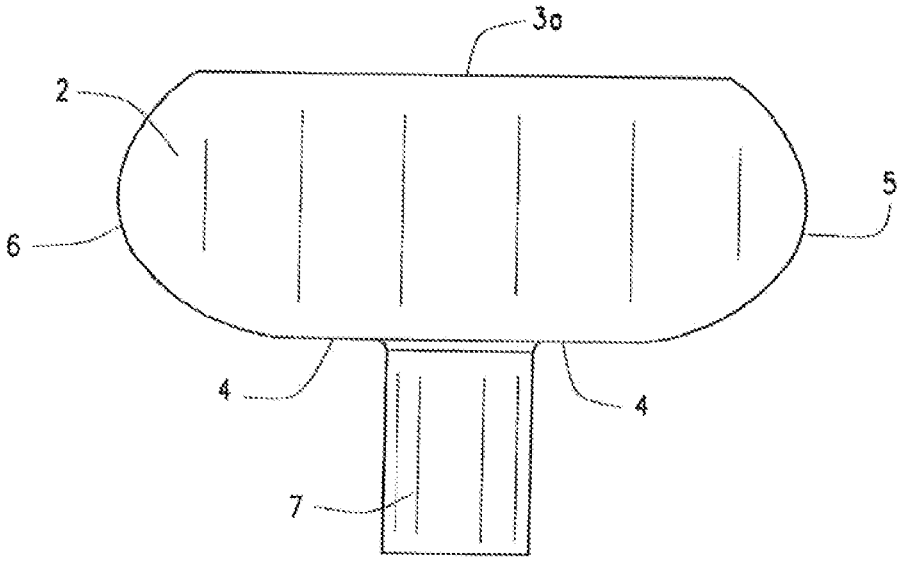
FIG. 2 shows a top view of the enclosure of the invention.

Turning to FIG. 2, the enclosure 1 has its lid 2 towards the foreground. The enclosure has its right side 5 towards the right of the lid in this figure. Opposite the right side, the enclosure has a left side 6 extending downwardly from the lid and perpendicular to the back surface 3*a* of the hull. The left side 6 has a rounded over joining to the back surface. The left side has a spacing apart from the right side. The left side and the right side span from the front to the back surface of the hull. Opposite the back surface, the enclosure has a front surface 4 of the hull generally parallel and spaced away form the back surface 3*a*. The front surface has its width generally less than the width of the back surface as shown. Centered upon the front surface 4 and collinear with the ridge of the top surface, the hull has an extension 7 outwardly from the front surface.

The extension has a width less than that of the front surface and a length nearly that of the spacing between the front surface and the back surface. The extension's width is typically a diameter of a round cylinder, as later shown, and the extension receives the light L as in FIGS. 1, 2.

Figure 3:
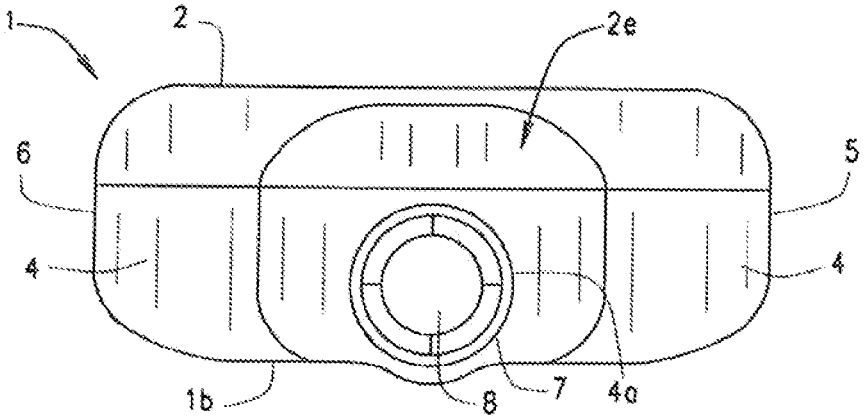
FIG. 3 provides a front view of the enclosure of the invention.

FIG. 3 shows the invention with the extension 7 in the foreground. The extension has a hollow round cylindrical shape as shown with a centered opening as at 8 for a male extension to accept the roadway light L. The opening allows for passage of wiring and making of connection with the light L. The extension extends rearward, into the plane of the figure, to a shoulder 4*a* upon the front surface 4 of the hull 3. The shoulder transitions the extension from its orientation perpendicular to the front surface to the plane of the front surface. The shoulder also has a greater thickness than the remainder of the front surface as it provides stiffening to enclosure in the proximity of the extension. Outwardly from the shoulder, the front surface 4 of the hull extends laterally to the left side 6 upon the left of the figure to the right side 5 upon the right of the figure. As previously mentioned, the various parts and surfaces of the enclosure at their mutually joining, have a generally rounded over form. The enclosure has few if any rectilinear corners. The enclosure of the invention sheds ice, sleet, snow, rain, bird droppings, and the like.

Figure 4:
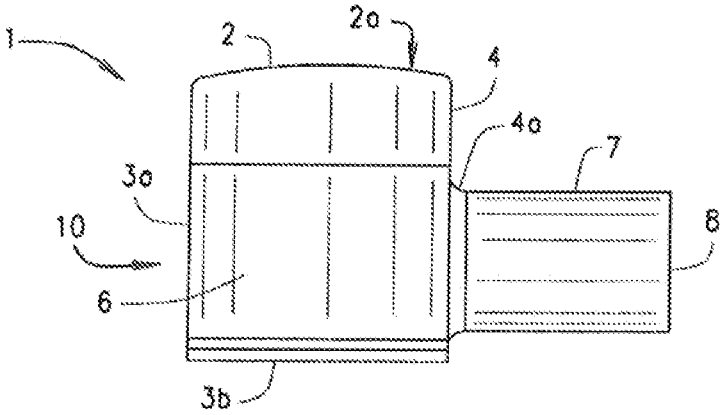
FIG. 4 shows a side view of the enclosure of the invention.

Viewing the invention from the left side 6, FIG. 4 has the invention in a side view with the extension 7 towards the right. The enclosure has its back surface of the hull 3 to the left. The back surface includes its female receiver 10 that accepts a cobra arm as later shown. Upwardly, the back surface of the hull 3 joins to the lid and downwardly, the back surface joins to a bottom surface 3*b* of the hull. The front surface 4 spans between the lid 2 and the bottom surface 3*b* spaced to the right of the back surface in this figure. The shoulder 4*a* transitions in thickness outwardly from the front surface and around the extension 7. The extension extends to the right in this figure and outwardly from the remainder of the invention. The extension has a generally cylindrical form with its opening 8 to the right and opposite the receiver 10 and collinear with the receiver, and a centered location upon the front 4.

Figure 5:
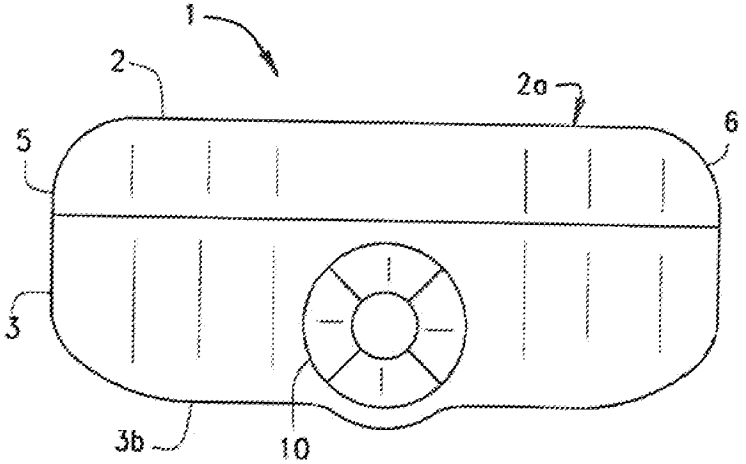
FIG. 5 provides a rear view of the enclosure of the invention.

FIG. 5 then shows a back view of the invention with the back surface of the hull 3 in the foreground of the figure. The back surface joins with the right side 5 here towards the left of the figure and the left side 6 opposite the right side. The back surface of the hull joins to the lid 2 as it spans between the right side and the left side. Spaced below the top surface and joining to the back surface, the enclosure's hull has the bottom surface 1*b*. The bottom surface is generally parallel to the top surface. Upon the back surface of the hull 3 generally towards the center widthwise but below the center height wise, a receiver 10 extends into the back surface and the enclosure. The receiver has a hollow form and a diameter suitable for a tight connection to a cobra arm as previously shown in FIGS. 1, 2. In an alternate embodiment, the receiver has a partial closure with a knockout panel which an installer may remove.

Figure 6:
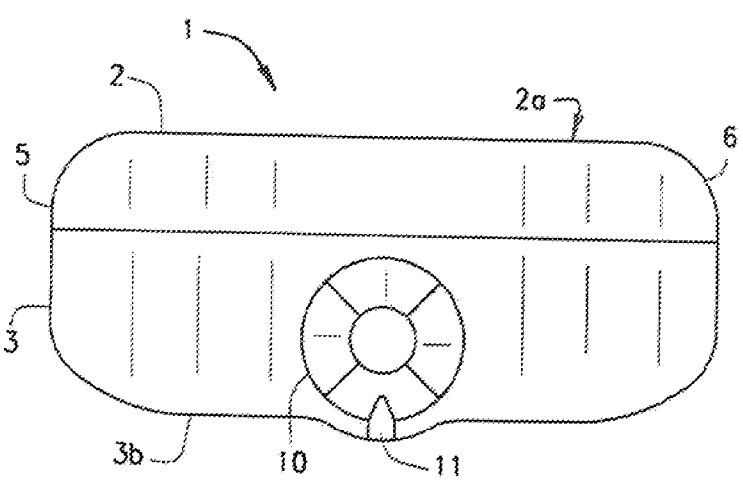
FIG. 6 provides a rear view of an alternate embodiment of the enclosure of the invention.

FIG. 6 shows an alternate embodiment of the receiver 10. Here the receiver has its position similar to that of FIG. 6. This embodiment of the receiver though has a notch 11 intersecting with the bottom surface and extending partially into the receiver. This notch 11 has a width comparable to existing strips of LED lighting as previously shown in FIGS. 1, 2. The notch admits the strips as needed for connection into the components of the invention contained within the enclosure. In an alternate embodiment, the receiver and the notch have a partial closure with a knockout panel which an installer may remove. This knockout panel separates cleanly to reveal the entire notch.

Figure 7:
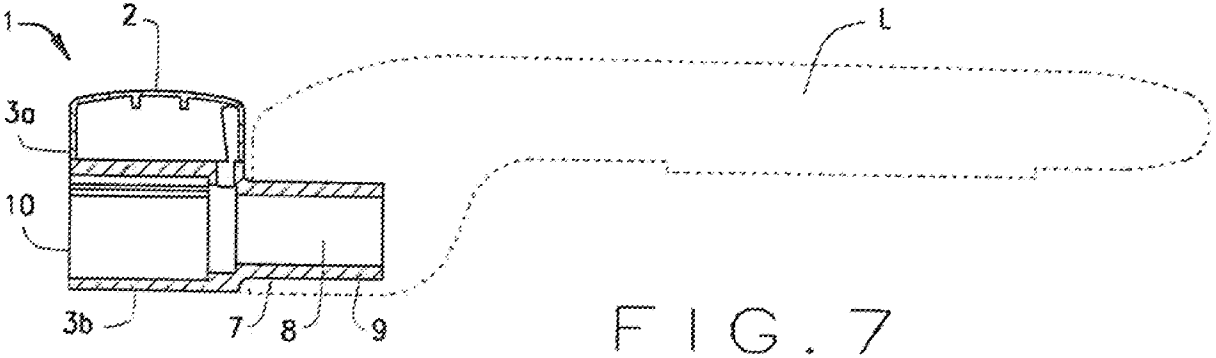
FIG. 7 shows a sectional view of the invention with an existing light connected to it.

FIG. 7 shows a section view of the invention to the left and the light L to the right with the light L fitted upon the extension 7. The invention has its form as previously shown and described. This view shows the back surface 3*a* to the left with its receiver 10 extending into the enclosure over half the height of the enclosure. The back surface spans between the bottom surface 3*b* and the lid 2. Opposite the receiver 10, the invention has its extension 7 coaxial with the receiver and having its opening 8 in communication with the receiver. In an alternate embodiment, the opening 8 does communicate into the receiver 10. The opening forms within a wall 9 of the cylindrical form of the extension 7. The wall of the extension forms a shape and diameter that receives an end, the female end, of a light L made by others. As previously shown in FIG. 1, the receiver 10 admits and fits upon a light pole, the extension 7 then fits into a light, and the enclosure has an inline installation upon the light pole.

Figure 8:
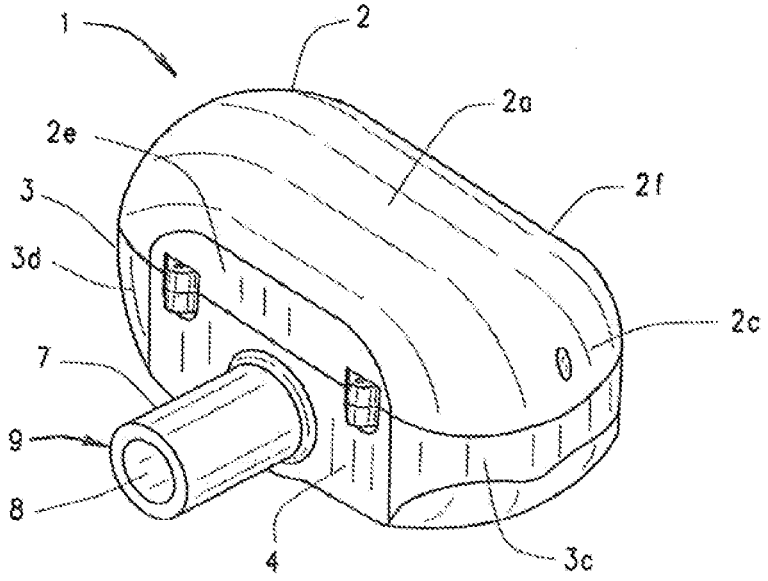
FIG. 8 shows a rear perspective view of the enclosure of the invention.

FIG. 8 then has a rear perspective view of the enclosure 1, ready for its insertion into an LED light assembly, previously shown in FIG. 7. The enclosure 1 has its lid 2 connecting to its hull 3 and the extension 7 extends outwardly from the back surface 3*a*. The lid fits contiguously upon the hull as later shown and described. The extension forms from the wall 9 having its thickness less than the diameter of the extension. The extension also has the opening 8 through it for passage of power and signal cabling. The lid itself has a top surface 2*a* somewhat rectangular in shape though its four corners are rounded downwardly. From the top surface 2*a*, the lid has a right side 2*c* and an opposite left side 2*d* shown inwardly in this figure. In this embodiment, the lid has a front edge 2*e* here towards the extension 7 and an opposite back edge 2*f*. The front end and the back edge span from the right side to the left side of the lid. Beneath the lid, the hull 3 itself has a somewhat prismatic rectangular shape though its four corners have a round comparable to that of the lid. The right side 3*c* and an opposite left side 3*d* also curve inwardly. The hull also has its front 4 with the extension from there and the opposite back surface 3*a*.

Figure 9:
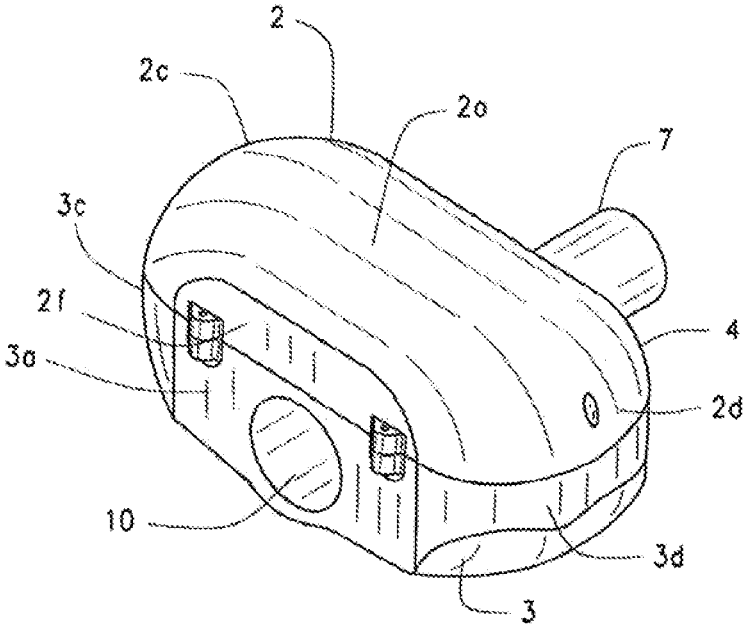
FIG. 9 shows front perspective view of the enclosure of the invention.

Turning the enclosure 1, FIG. 9 describes a front perspective view of the enclosure 1 opposite that of FIG. 8. The enclosure has the lid 2 upon the hull 3 as described above. In this view, the back edge 2*f* appears in the foreground upon the back surface 3*a*. The back surface has the female receiver 10 generally centered thereon so that it fits upon a light pole. The lid has its right side 2*c* away from the left side 2*d* in the foreground. Beneath the lid, the hull has its right side 3*c* also away from its right side 3*d* in the foreground. The lid secures upon the hull cooperatively in a compact form that fits inline between a light L and the cobra arm C as previously shown.

Figure 10:
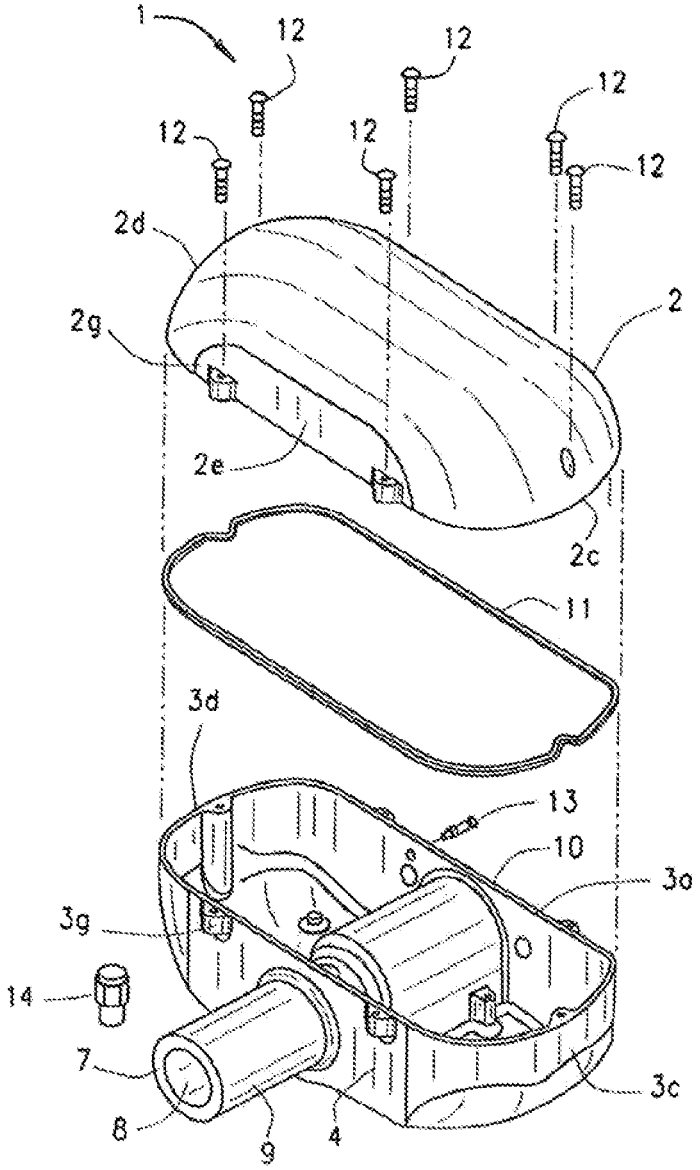
FIG. 10 illustrates an exploded view of the enclosure of the invention.

FIG. 10 illustrates an exploded view of the enclosure 1 based upon FIG. 8. The lid 2 has its somewhat rectangular form with rounded corners and rounded edges as previously shown and described. The lid has its top surface 2*a*, right side 2*c*, left side 2*d*, front surface 2*e*, and back surface 2*f*. The front surface also includes two spaced apart tabs 2*g* as shown that receive screws 12. The screws 12 have the form of security screws that prevent unauthorized entry into the enclosure 1 following its installation. In an alternate embodiment, the lid secures to the hull utilizing bayonet lock, snap fittings, swaging, adhesives, cohesives, or welding.

The left side and the right side also receive screws 12 therein. The back surface also has two spaced apart tabs, not shown. The tabs 2*g* have a position proximate the lip as later shown and described. The tabs extend outwardly from the front and the back surface as later shown. Beneath the lid, the enclosure has a cord 11 generally forming a closed shape. The cord has a thin width and depth and sufficient length to follow the perimeter of the enclosure. The cord 11 fits snugly within cooperating features of the lid and the hull so that the enclosure becomes waterproof. The cord has the construction of a compressible, water expelling material such as polymer, rubber, artificial rubber, oakum, and the like.

The cord assists the lid to fit upon the hull and thus make the enclosure 1 waterproof.

Under the lid and the cord in this figure, the enclosure 1 has its hull 3 that has its back surface 3*a*, front 4, right side 3*c*, and left side 3*d*. The back surface, right side, and left side curve downwardly and inwardly and merge with the bottom surface, not shown. The back surface, right side, left side, front, and bottom surface form a volume within them suitable for placement and storage of electrical and electronic equipment and components. The back surface includes the receiver 10 that opens into the hull. The receiver has additional components in the hull as later shown and described in FIG. 11. The receiver continues its hollow form to the front 4 and the extension 7 extends outwardly from the shoulder 4*a*. The receiver has an orientation transverse upon the hull from the back surface to the front. The extension has a hollow, cylindrical shape with its wall 9 of a thickness containing an opening 8. The opening 8 of the extension communicates with the receiver 10 so that wiring, not shown, may pass into and through the enclosure 1. The receiver has a collinear orientation with the extension. The receiver also has a gasket 14 here shown for installation just behind the front 4. Opposite the front, the back surface 3*a* also has at least one aperture that receives a cooperating screw 13 here shown to the left of the receiver. In an alternate embodiment, the back surface has two apertures and their cooperating screws 13 symmetrically placed flanking the receiver 10.

Figure 11:
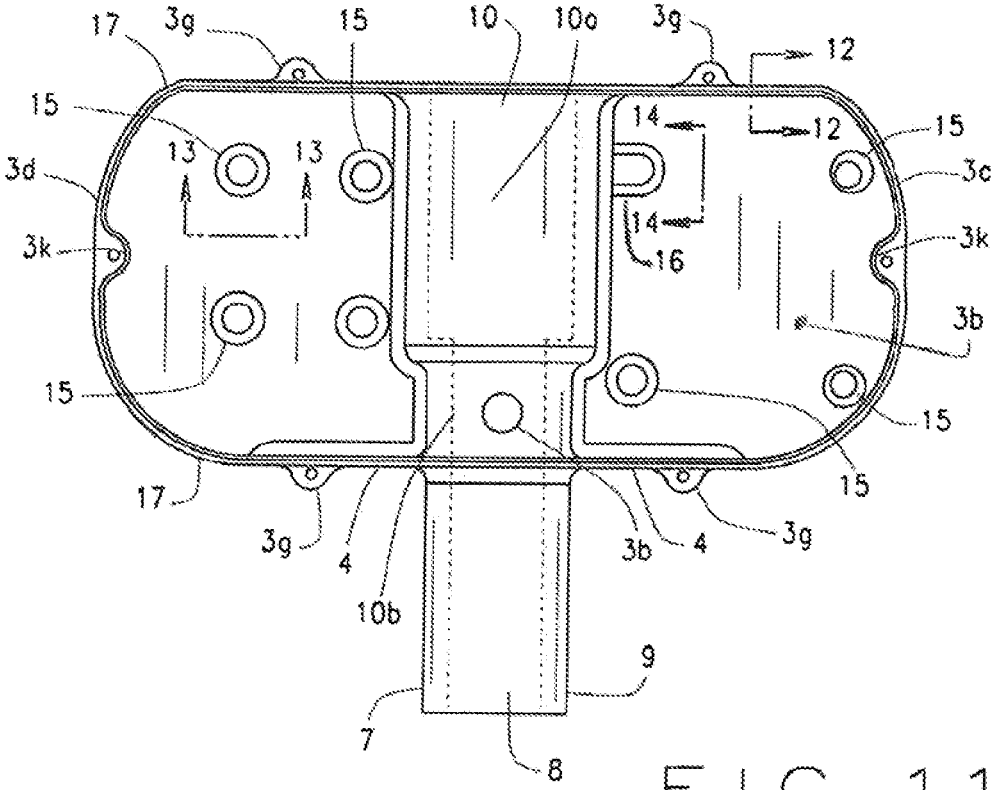
FIG. 11 shows a top view of the lower portion of the enclosure of the invention.

FIG. 11 shows a top view of the lower portion, or hull 3 of the enclosure 1 with the lid removed. The hull has the back surface 3*a* here shown towards the top of the figure. The back surface has the receiver 10 generally centered therein. Outwardly from the receiver, the back surface has two tabs 3*g* having threaded apertures therein that receive screws 12 inserted through aligned, cooperating tabs of the lid for securement of the lid to the hull. The receiver 10 extends into the hull 3 with a first chamber 10*a* adjoining the back surface. The first chamber is round and has a diameter suitable for accepting a male fitting of a light pole used in the industry. The first chamber is hollow and has a length over half of the width of the hull. The length accommodates a light pole fitting in a snug manner. Following the first chamber, the receiver 10 continues to an adjoining second chamber 10*b* that has a stepped in diameter of lesser size than that of the first chamber though the second chamber is collinear with the first chamber. The second chamber is also round and hollow, has a diameter and a length less than that of the first chamber, and a location opposite the back surface. The second chamber has a threaded aperture 3*h* that receives the gasket 14. The gasket allows for ventilation of the receiver and the extension during usage but does not admit moisture therein. The second chamber then merges with the front 4 of the hull. The second chamber then opens into and communicates to the extension 7 outwardly from the front, that is, towards the bottom of the figure. The extension 7 has a diameter similar to that of the second chamber. The extension has its cylindrical form from the wall 9 and the opening 8 passing through the length of the extension.

Inwardly in the figure, the hull has the bottom surface 3*b* beneath the receiver 10 and the extension 7. The bottom surface extends from the back surface 3*a* to the front 4 and from the right side 3*c* to the left side 3*d*. The bottom surface is continuous with the back surface, the front 4, the right side, and the left side. The bottom surface has a plurality of first standoffs 15 spaced upon it and at least one second standoff 16. The second standoff extends outwardly from the first chamber 10*a* in the direction of the right side 3*c*. The first standoffs and the second standoff have an axial threaded aperture if needed for securement by a screw or other mechanical fastener. The second standoff has a greater height from the bottom surface than that of the first standoffs. The threaded aperture extends partially into the second standoff for an end opposite the bottom surface.

The bottom surface merges with the right side 3*c* and the left side 3*d*. The right side and the left side have generally curved, convex shapes as they span from the back surface 3*a* to the front 4. The right side and the left side are mirror images of each other and generally symmetrical about an axis through the receiver and the extension. The right side and the left side each have an indent 3*k*. The indent has an axial threaded aperture for admitting a screw as previously shown in FIG. 10.

At the plane of this figure, the back surface 3*a*, the right side 3*c*, the front 4, and the left side 3*d* each have a lip 17. The lip receives the continuous cord 11 previously shown in FIG. 10. The lip has a continuous path upon the back surface 3*a*, the right side 3*c*, the front 4, and the left side 3*d* and it extends inwardly upon the indents 3*k* on both sides.

Figure 12:
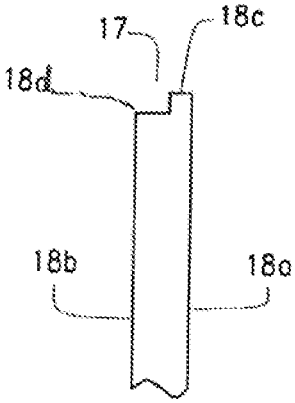
FIG. 12 shows a sectional view for the lower portion of the enclosure of the invention.

FIG. 12 shows a first sectional view through a portion of the hull 3. This section is for the lip 17 that extends around the perimeter of the hull and the two indents 3*k* shown in FIG. 11. The lip thus appears on the back surface, the right side, the front, and the left side in a continuous manner. For this figure, the back surface, the right side, the front, and the left side carry a common reference character 18 for a wall. The lip 17 has a position upon the wall and opposite the bottom surface, that is, towards the lid. The wall 18 has an outer face 18*a* and an opposite inner face 18*b* where the outer face appears to a person viewing the enclosure and the inner face remains conceal upon placing the lid 2 upon the hull 3. The outer face extends upwardly in this figure for a short distance further than the inner face. The outer face terminates in a strip 18*c* of a width generally less than half of the thickness of the wall 18 shown and has a height above the inner face similar to its width. The strip is off center upon the wall. Inwardly from the strip 18*c*, that is, to the left in the figure, the wall 18 has a shelf 18*d* extending from the strip to the inner surface. The shelf is generally perpendicular to the outer face 18*a* and has a width over half of the thickness of the wall. The lip also jogs inwardly upon the indents 3*k*. The lip mates with a cooperating feature upon the lid as later described.

Figure 13:
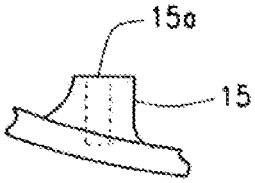
FIG. 13 shows a sectional view for the lower portion of the enclosure of the invention.

Related to the bottom surface, FIG. 13 has a second sectional view through another portion of the hull showing a first standoff 15. The bottom surface 3*b* has its generally curved form as shown. Extending inwardly, that is, upwardly in this figure, the first standoff achieves a short height above the bottom surface generally towards the lid, not shown. The first standoff has a threaded aperture therein as at 15*a* for a mechanical fastener.

Figure 14:
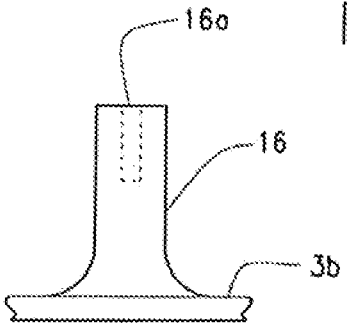
FIG. 14 shows a sectional view for the lower portion of the enclosure of the invention.

Also on the bottom surface 3*b*, FIG. 14 shows a third sectional view of the hull 3 with a second stand off 16. The second standoff has a location merged with the first chamber 10*a* towards the right side 3*c* as previously shown. Extending inwardly, that is, upwardly in this figure, the second standoff 16 achieves its height above the bottom surface generally towards the lid, not shown. The second standoff has a greater height above the bottom surface than the first standoff. The second standoff also has its threaded aperture as at 16*a* for a mechanical fastener.

Figure 15:
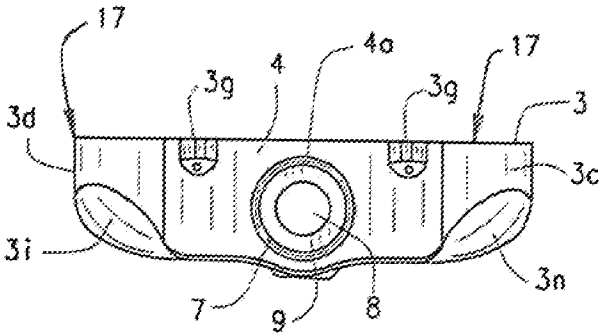
FIG. 15 provides a front view for the lower portion of the enclosure of the invention.

FIG. 15 then describes a front view of the hull 3 with the extension 7 extending from the front 4 out of the plane of the figure towards the reader. The extension has its round end formed from the wall 9 into a cylindrical shape as previously shown. The extension has its opening 8 that communicates through the hull into the receiver 10 in the background. The extension approaches the remainder of the hull and flares slightly outwardly at the shoulder 4*a*. The shoulder continues around the perimeter of the extension. The shoulder then transitions to the plane of the front 4. The front is generally perpendicular to the extension and in the plane of this figure. Upwardly and outwardly from the extension, that is, towards the lip 17, the front has its two tabs 3*g* mutually spaced apart and extending out of the plane. The right side 3*c* and the left side 3*d* then curve away from the front 4 into the plane of the figure and towards the back surface, not shown. The right side 3*c* and the left side 3*d* each have a swale 3*n* formed into them that has a maximum height at the front, a minimum height at approximately forty five degrees of rotation, and then returns to a maximum height at the back surface. The hull has its height generally measured from the bottom surface 3*b* to the rim 17.

Figure 16:
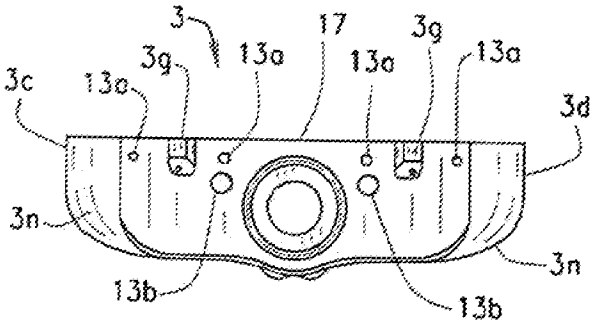
FIG. 16 provides a rear view for the lower portion of the enclosure of the invention.

Turning the hull, FIG. 16 provides a rear view of the hull such as before placement of the enclosure 1 upon an existing light pole. The hull's back surface 3*a* shown here has the receiver 10 opening into the plane of the figure. The back surface has a generally planar form and perpendicular to an axis through the receiver 10 into the opening of the extension. The back surfaces widens outwardly from the receiver and has a somewhat rectangular form as shown with a greater width than that of the front 4 of FIG. 15. Upwardly and outwardly from the receiver 10, or towards the lip 17, the back surface 3*a* also has two tabs 3*g* mutually spaced apart and extending out of the plane. The right side 3*c* and the left side 3*d* then curve away from the back surface 3*a* into the plane of the figure and towards the front, not shown. The right side 3*c* and the left side 3*d* each have a swale 3*n* formed into them that has a maximum height at the back surface and a minimum height at approximately forty five degrees of rotation into the plane of the figure and then returns to a maximum height at the front. The back surface has at least two apertures 13*a* that receive screws 13 for securement of the lid to the hulls. This figure shows four apertures 13*a* as the most likely configuration. The back surface also has at least one second aperture 13*b* proximate the receiver and near a tab 3*g*. This figure shows two second apertures 13*b* as the most likely configuration.

Figure 17:
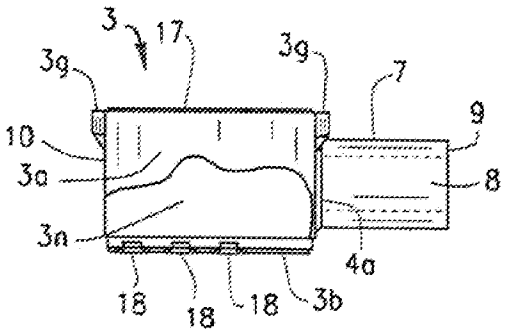
FIG. 17 shows a side view for the lower portion of the enclosure of the invention.

Turning the hull slight, FIG. 17 has a side view of it. The left side 3*d* and the right side 3*c* are symmetric thus this description applies to both. The back surface 3*a* appears on edge to the left of the figure and has a tab 3*g* extending towards the left at the lip 17. From the back surface, each side 3*c*, 3*d*, extends rightward. Each side curves gently along its length as previously shown in FIG. 11. In the lower portion of each side, a swale 3*n* brings in the curve so that the bottom surface 3*b* appears smaller than the lid above. The bottom surface 3*b*, here also shown on edge, has at least two ports 18 formed therein. This figure shows three ports 18 as the most likely configuration. The ports have a generally collinear placement more towards the back surface 3*a* than the front 4. Each side then curves around into the front 4 with its shoulder 4*a* extending outwardly to the right from the hull. The front also has a tab 3*g* shown at the lip 17. From the shoulder and below the lip, the extension 7 orients to the right with its opening 8 in the wall 9 at the right of this figure.

Figure 18:
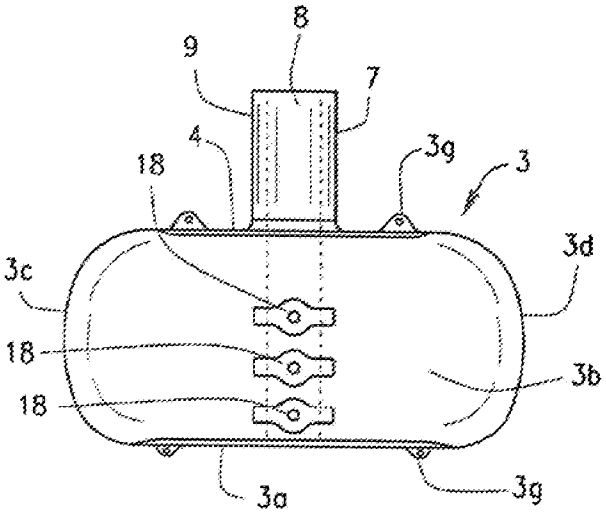
FIG. 18 shows a bottom view for the lower portion of the enclosure of the invention.

And, FIG. 18 shows a bottom view of the hull 3 with the bottom surface 3*b* in the foreground and the extension 7 upwardly. Aligned with the first chamber 10*a* of the receiver 10, the bottom surface has the ports 18. The ports have a reinforced rim and then a thickening of the bottom surface in an elongated rectangular form upon a diameter of a port and perpendicular to an axis through the extension to the receiver. The reinforcing of the rim has a greater width than the narrow portion of the rectangular form. The bottom surface shows two tabs 3*g* outwardly from the back surface towards the bottom of the figure and two tabs also outwardly from the front. The two tabs on the front have the extension 7 extending outwardly between them. In this view, the extension has a length from the front generally less than the width of the hull from the back surface to the front.

Figure 19:
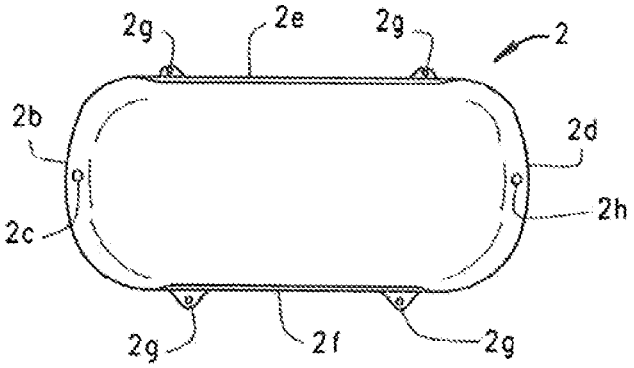
FIG. 19 shows a top view of the upper portion of the enclosure of the invention.

The enclosure 1 also has a key component in its lid 2 and FIG. 19 provides a top view of the upper portion, or lid 2 of the invention. The lid itself has its top surface 2*a* somewhat rectangular in shape with four rounded corners. From the top surface 2*a*, the lid has its right side 2*c* and the opposite left side 2*d* shown to the right in this figure. In this embodiment, the lid has its front edge 2*e* here shown upwardly and an opposite back edge 2*f*. The front end and the back edge span from the right side to the left side of the lid and complete the rounding of the corners. The front edge has two tabs 2*g* extending slightly outwardly, that is, upwardly in the figure. These two tabs remain within the limits of the front edge and align with cooperating tabs upon the front of the hull as previously shown and described. Meanwhile, the back edge 2*f* also has two tabs 2*g* extending slightly outwardly, that is, downwardly in the figure. These two tabs remain slightly outside the limits of the back edge and also align with cooperating tabs upon the back surface of the hull as previously shown and described. The top surface also has two centered apertures 2*h* symmetrically placed and proximate the left side and the right side as shown. The apertures 2*h* receive screws 12 for securement of the lid to the hull at the indents 3*k*. The lid's front edge 2*e* and back edge 2*f* align with the front 4 and back surface 3*a* of the hull for a snug connection.

Figure 20:
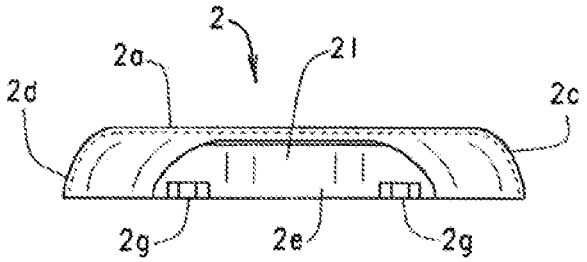
FIG. 20 provides a front view for the upper portion of the enclosure of the invention.

Turning the lid, FIG. 20 has a front view of it with the front edge 2*e* towards the foreground. The front edge has a planar portion 21 generally perpendicular to the top surface 2*a*. The two tabs 2*g* occupy symmetric positions upon the planar portion opposite the top surface. The planar portion has rounding towards the right side 2*c* and the left side 2*d*. The right side and the left side curve upwardly and inwardly to the top surface 2*a*. Here in this figure, the left side and the right side establish a height for the lid. This lid height is generally less than the height of the hull beneath the lid.

Figure 21:
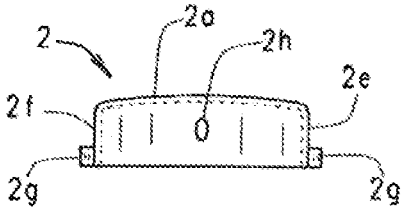
FIG. 21 shows a side view for the lower portion of the enclosure of the invention.

The FIG. 21 describes a side view of the lid 2. The lid is symmetric and thus this view and its description apply to both the right side 2*c* and the left side 2*d*. The lid 2 has its top surface 2*a* that extends downwardly to the front edge 2*e* on the right and the back edge 2*f* on the right in this figure. Between the top surface, the front edge, and the back edge, the lid has its side, either left side 2*d* or right side 2*c*. Upon the side, the lid has its aperture 2*h* that receives a securing screw. The aperture is proximate the center of the side. Towards the right of this figure, outwardly from the front edge 2*e*, and opposite the top surface, the lid has two tabs 2*g*. Then outwardly from the back edge 2*f*, the lid has its other two tabs 2*g* here shown to the left of the figure.

Figure 22:
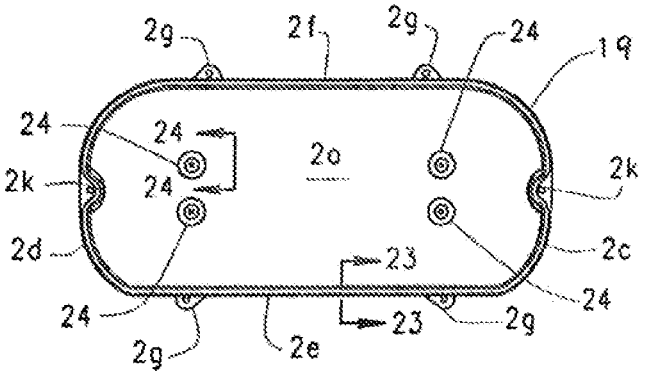
FIG. 22 shows a bottom view for the lower portion of the enclosure of the invention.

FIG. 22 shows a bottom view of the lid 2, or upper portion of the enclosure 1 without the hull shown. The lid has hits back edge 2*f* here shown towards the top of the figure. Outwardly from the center of the back edge, the lid has two tabs 2*g* having threaded apertures therein that receive screws 12 inserted through aligned, cooperating tabs of the hulls.

Inwardly in the figure, the lid has its top surface 2*a* that extends from the back edge 2*f* to the front edge 2*e* and from the right side 2*c* to the left side 2*d*. The top surface is continuous with the back edge, the front edge, the right side, and the left side. The top surface has a plurality of third standoffs 24 spaced upon it, here showing as four in number. The third standoffs have a paired arrangement symmetric left side to right side but off center from back edge to front edge as shown. The third standoffs have an axial threaded aperture if needed for securement by a screw or other mechanical fastener. The threaded aperture extends into the third standoff for an end opposite the top surface. The third standoffs define a common plane spaced beneath the top surface.

The top surface 2*a* merges with the right side 2*c* and the left side 2*d*. The right side and the left side have generally curved, convex shapes as they span from the back edge 2*f* to the front edge 2*e*. The right side and the left side are mirror images of each other and generally symmetrical about an axis through the center of the lid from left to right. The right side and the left side each have an indent 2*k*. Each indent has an axial threaded aperture for admitting a screw as previously shown in FIG. 10.

At the plane of this figure, the back edge 2*f*, the right side 2*c*, the front edge 2*e*, and the left side 2*d* each have a second lip 19. The second lip also receives the cord 11 previously shown in FIG. 10. The lip has a continuous path upon the back edge 2*f*, the right side 2*c*, the front edge 2*e*, and the left side 2*d* and it extends inwardly upon the indents 2*k* on both sides. The second lip, in plan view, has a similar shape as the lip of the hull. The second lip receives the cord 11 and then the lip 17 adjoins the second lip 19 to seal the enclosure 1 against water and other hazards.

Figure 23:
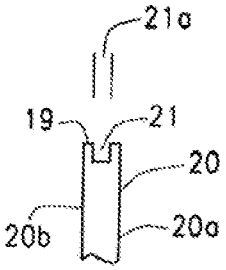
FIG. 23 shows a sectional view for the upper portion of the enclosure of the invention; and, FIG. 24 shows a sectional view for the upper portion of the enclosure of the invention.

FIG. 23 has a sectional view for a portion of the lid 2, for the second lip 19 that extends around the perimeter of the lid and the two indents 2*k* shown in FIG. 22. The second lip thus appears on the back edge, the right side, the front edge, and the left side in a continuous manner. For this figure, the back surface, the right side, the front, and the left side carry a common reference character 20 for a second wall. The second lip having a location upon the second wall and beneath the top surface, that is, towards the hull. The second wall 20 has an outer face 20*a* and an opposite inner face 20*b* where the outer face appears to a person viewing the enclosure and the inner face remains concealed upon placing the lid 2 upon the hull 3. The outer face extends upwardly in this figure for a similar distance as the inner face. Between the outer face and the inner face and opposite the top surface, the second wall 20 has a centered groove 21. The centered groove divides the thickness of the second wall where the outer face and the inner face terminate. The centered groove has its own width 21*a* leaving a portion of the second wall's thickness divided between the inner face and the outer face. The centered groove receives the cord 11 as shown. The second lip also jogs inwardly upon the indents 2*k*. The second lip mates with the cooperating first lip particularly the outer wall upon the hull as previously described.

Figure 24:
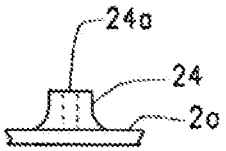

And, FIG. 24 illustrates a sectional view for a third standoff 24 depending from the top surface 2*a* of the lid 2. The top surface 2*a* has its generally flat form as shown. Extending inwardly, that is, upwardly in this figure, the third standoff 24 achieves a short height above the top surface generally towards the hull, not shown. The third standoff also has its threaded aperture therein as at 24*a* for a mechanical fastener. The third standoff has a height less than that of the second standoff previously shown.

From the aforementioned description, a cobra arm enclosure device has been described. The cobra arm enclosure device is uniquely capable of locating electrical components near a light fixture, protecting those components from the elements, and allowing remote communication to those components for operation of the light fixture. The cobra arm enclosure device and its various components may be may be manufactured from many materials, including but not limited to, die cast aluminum for the housing, polymers, polyethylene, polypropylene, nylon, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

The invention claimed is:

1. A method for installing an enclosure device in-line on a municipal light pole comprising:

providing a cobra arm having a first end and an opposing second end;

providing a municipal light pole having said first end of said cobra arm attached thereto;

providing a municipal light attached to said second end of said cobra arm;

providing an enclosure device comprising:

a hull defining an interior volume configured to enclose electronic components, said electronic components including a power supply, a computer processor, and a wireless node;

a receiver centered within said interior volume and having an opening on a first side of said hull; and an extension centered on an exterior side of said enclosure device opposite said first side, said extension extending outwardly from said device, said extension being collinear with said receiver, and said extension being in communication with said receiver;

removing said municipal light from said second end of said cobra arm;

attaching said receiver of said enclosure device on said second end; and attaching said extension of said enclosure device to said municipal light.

2. The method of claim 1, wherein said receiver is collinear with said extension.

3. The method of claim 1, wherein said enclosure device comprises a hull bottom and a hull top and said hull top fits contiguously upon said hull bottom.

4. The method of claim 3, wherein said receiver and said extension are disposed on said hull bottom.

5. The method of claim 4, wherein when said enclosure device is attached to said cobra arm, said enclosure device is inverted.

6. The method of claim 3, wherein said enclosure device further comprises a cord disposed between said hull top and said hull bottom to form a seal when said enclosure device is assembled.

7. The method of claim 1, wherein said interior volume is configured to enclose electronic components.

8. The method of claim 7, wherein said electronic components include a power supply, a computer processor, and a radio.

9. The method of claim 8, further comprising: installing said power supply, said computer processor, and said radio in said interior volume.

10. The method of claim 9, further comprising: connecting said power supply to a municipal power line of said municipal light pole.

11. The method of claim 10, further comprising: installing a light-emitted diode (LED) light strip on a length of said cobra arm.

12. The method of claim 11, further comprising: supplying power to said LED light strip by said power supply converting electrical power of said municipal power line.

13. The method of claim 11, further comprising: said computer processor controlling said municipal light.

14. The method of claim 10, further comprising: supplying power to said computer processor and said radio by said power supply converting electrical power of said municipal power line.

15. The method of claim 9, further comprising: installing on an exterior surface of said enclosure device an antenna communicating with a signal control hub adapted to communicate with a cloud server application.

16. The method of claim 15, wherein said municipal light pole is one municipal light pole in a plurality of municipal light poles remotely operated by a user of said cloud server application.

17. The method of claim 16, wherein remotely operating said plurality of municipal light poles comprises modifying the state of a mesh network defined in part by said antenna and signal control hub.

18. The method of claim 17, further comprising remotely receiving information about said mesh network.

19. The method of claim 16, wherein remotely operating said plurality of municipal light poles comprises said user sending commands to said plurality of municipal light poles.

20. An enclosure device comprising:

a hull defining an interior volume configured to enclose electronic components, said electronic components including a power supply, a computer processor, and a wireless node;

a receiver centered within said interior volume and having an opening on a first side of said hull, said receiver configured to accept a municipal light cobra arm via said opening; and an extension centered on an exterior side of said enclosure device opposite said first side, said extension extending outwardly from said device and configured to insert into a municipal light, said extension being collinear with said receiver, and said extension being in communication with said receiver.

21. The enclosure device of claim 20, further comprising said power supply, said computer processor, and said wireless node disposed in said interior volume.

22. The enclosure device of claim 21, further comprising an aperture through said hull.

23. The enclosure device of claim 22, further comprising an antenna disposed on an external surface said hull and in electric communication with said electronic components through said aperture.

24. The enclosure device of claim 20, wherein said hull comprises a hull bottom and a hull top fitting contiguously upon said hull bottom.

25. The enclosure device of claim 24, wherein said receiver and said extension are disposed on said hull bottom.

26. The enclosure device of claim 24, wherein said receiver and said extension are disposed on said hull top.

27. The enclosure device of claim 24, wherein said enclosure device further comprises a cord disposed between said hull top and said hull bottom to form a seal when said enclosure device is assembled.

28. The enclosure device of claim 27, wherein said seal is waterproof.

29. The enclosure device of claim 27, wherein said hull top and said hull bottom each comprise a plurality of tabs extending outwardly from a periphery thereof and located such that when said hull bottom and hull top are assembled, one tab from each plurality is mutually aligned.

* * * * *